US006475303B1

(12) United States Patent
Hasegawa et al.

(10) Patent No.: US 6,475,303 B1
(45) **Date of Patent: *Nov. 5, 2002**

(54) MAGNETIC GLASSY ALLOYS FOR ELECTRONIC ARTICLE SURVEILLANCE

(75) Inventors: Ryusuke Hasegawa, Morristown; Howard H. Liebermann, Succasunna; Ronald J. Martis, East Honover, all of NJ (US)

(73) Assignee: Honeywell International Inc., Morris Township, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/633,058

(22) Filed: Aug. 8, 2000

Related U.S. Application Data

(63) Continuation-in-part of application No. 09/290,642, filed on Apr. 12, 1999.

(51) Int. Cl.[7] ..... H01F 1/153
(52) U.S. Cl. ..... 148/304
(58) Field of Search ..... 148/304

(56) References Cited

U.S. PATENT DOCUMENTS

| | | | | |
|---|---|---|---|---|
| 3,856,513 A | | 12/1974 | Chen et al. | 75/122 |
| 4,510,489 A | | 4/1985 | Anderson et al. | 340/572 |
| 4,755,239 A | * | 7/1988 | O'Handley | 148/304 |
| 5,037,494 A | | 8/1991 | Hilzinger et al. | 148/304 |
| 5,284,528 A | | 2/1994 | Hasegawa et al. | 149/304 |

FOREIGN PATENT DOCUMENTS

JP 61-261451 4/1987

OTHER PUBLICATIONS

Y. Takada, et al., "Commercial Scale Protection of Fe–6.54 wt..", J. Appl. Phys. 64(10), pp. 5367–5368, Nov. 15, 1988.

C.D. Graham, et al., "Magnetism and Magnetic Materials—1975", Americal Institute of Physics, pp. 745–746, New York, 1975.

S. Ohnuma, et al., "Rapidly Quenched Metals III," The Metals Society, vol. 2, pp. 197–204.

Ho et al., *Effects of Magnetic and Stress Annealing on the Change in Magnetorestriction for Magnetically Soft Amorphous Alloys*, J. Mangetism and Magnetic Materials, vol. 119, No. 3, pp. 318–320 (Feb. 2, 1993).

* cited by examiner

*Primary Examiner*—John Sheehan
(74) *Attorney, Agent, or Firm*—Roger H. Criss

(57) ABSTRACT

A glassy metal alloy consists essentially of the formula $Co_aNi_bFe_cM_dB_eSi_fC_g$, where M is at least one element selected from the group consisting of Cr, Mo, Mn and Nb, "a–g" are in atom percent and the sum of "a–g" equals 100, "a" ranges from about 25 to about 60, "b" ranges from about 5 to about 45, "c" ranges from about 6 to about 12, "d" ranges from about 0 to about 3, "e" ranges from about 5 to 25, "f" ranges from about 0 to about 15 and "g" ranges from about 0 to 6, said alloy having a value of the saturation magnetostriction between −3 ppm and +3 ppm. The alloy can be cast by rapid solidification from the melt into ribbon, sheet or wire form. The alloy exhibits non-linear B—H hysteresis behavior in its as-cast condition. The alloy is further annealed with or without magnetic field at temperatures below said alloy's first crystallization temperature, having non-linear B—H hysteresis loops. The alloy is suited for use as a magnetic marker in electronic article surveillance systems utilizing magnetic harmonics.

4 Claims, 1 Drawing Sheet

MAGNETIC GLASSY ALLOYS FOR ELECTRONIC ARTICLE SURVEILLANCE

CROSS REFERENCE TO RELATED APPLICATIONS

This is a continuation-in-part of U.S. application Ser. No. 09/290642, filed Apr. 12, 1999 entitled Magnetic Glassy Alloys for High Frequency Applications.

FIELD OF INVENTION

The present invention relates to metallic glass alloys for use in electronic article surveillance systems.

BACKGROUND OF INVENTION

Metallic glass alloys (amorphous metal alloys or metallic glasses) have been disclosed in U.S. Pat. No. 3,856,513, issued Dec. 24, 1974 to H. S. Chen et al. (the "'513" Patent) These alloys include compositions having the formula $M_aY_bZ_c$, where M is a metal selected from the group consisting of iron, nickel, cobalt, vanadium and chromium; Y is an element selected from the group consisting of phosphorus, boron and carbon; Z is an element selected from the group consisting of aluminum, silicon, tin, germanium, indium, antimony and beryllium; "a" ranges from about 60 to 90 atom percent; "b" ranges from about 10 to 30 atom percent; and "c" ranges from about 0.1 to 15 atom percent. Also disclosed are metallic glass wires having the formula $T_iX_j$, where T is at least one transition metal and X is an element selected from the group consisting of phosphorus, boron, carbon, aluminum, silicon, tin, germanium, indium, antimony and beryllium, "i" ranges from about 70 to 87 atom percent and "j" ranges from about 13 to 30 atom percent. Such materials are conveniently prepared by rapid quenching from the melt using processing techniques that are now well known in the art.

Metallic glass alloys substantially lack any long-range atomic order and are characterized by x-ray diffraction patterns consisting of diffuse (broad) intensity maxima, qualitatively similar to the diffraction patterns observed for liquids or inorganic oxide glasses. However, upon heating to a sufficiently high temperature, they begin to crystallize with evolution of the heat of crystallization; correspondingly, the x-ray diffraction pattern thereby begins to change from that observed for amorphous materials to that observed for crystalline materials. Consequently, metallic alloys in the glassy form are in a metastable state. This metastable state of the alloy offers significant advantages over the crystalline form of the alloy, particularly with respect to the mechanical and magnetic properties of the alloy.

Use of metallic glasses in magnetic applications has been disclosed in the '513 Patent. However, certain combinations of magnetic properties are needed to realize magnetic components required in modern electronics technology. For example, U.S. Pat. No 5,284,528 issued Feb. 8, 1994 to Hasegawa et al., addresses such a need. One of the important magnetic properties that affects the performance of a magnetic component used in electrical or electronic devices is called magnetic anisotropy. Magnetic materials are, in general, magnetically anisotropic and the origin of the magnetic anisotropy differs from material to material. In crystalline magnetic materials, one of the crystallographic axes could coincide with the direction of magnetic anisotropy. This magnetically anisotropic direction then becomes the magnetic easy direction in the sense that the magnetization prefers to lie along this direction. Since there are no well-defined crystallographic axes in metallic glass alloys, magnetic anisotropy could be considerably reduced in these materials. This is one of the reasons that metallic glass alloys tend to be magnetically soft, which makes them useful in many magnetic applications. The other important magnetic property is called magnetostriction, which is defined as a fractional change in physical dimension of a magnetic material when the material is magnetized from the demagnetized state. Thus, magnetostriction of a magnetic material is a function of applied magnetic field. From a practical standpoint, the term "saturation magnetostriction" ($\lambda_s$) is often used. The quantity $\lambda_s$ is defined as the fractional change in length that occurs in a magnetic material when magnetized along its length direction from the demagnetized to the magnetically saturated state. The value of magnetostriction is thus a dimensionless quantity and is given conventionally in units of microstrain (i.e., a fractional change in length, usually parts per million or ppm).

Magnetic alloys of low magnetostriction are desirable for the following reasons:

1. Soft magnetic properties characterized by low coercivity, high permeability, etc. are generally obtained when both the saturation magnetostriction and the magnetic anisotropy of the material become small. Such alloys are suitable for various soft magnetic applications, especially at high frequencies.
2. When magnetostriction is low and preferably zero, magnetic properties of such near-zero magntostrictive materials are insensitive to mechanical strain. When this is the case, there is little need for stress-relief annealing after winding, punching or other physical handling needed to form a device from such material. In contrast, magnetic properties of stress-sensitive materials are considerably degraded by even small elastic stresses. Such materials must be carefully annealed after the final forming step.
3. When magnetostriction is near zero, a magnetic material under ac excitation shows a small magnetic loss due to a low coercivity and to reduced energy loss by reduced magneto-mechanical coupling via magnetostriction. Thus, near-zero magnetostrictive magnetic materials are useful where low magnetic loss and high permeability are required. Near-zero magnetostrictive material is, therefore, desirable when it is used as a marker in an article surveillance system based on utilizing higher harmonics generated by the marker. U.S. Pat. No. 4,553,136 issued on Nov. 12, 1985 to Anderson et al addresses such a case.

There are three well-known crystalline alloys of zero or near-zero magnetostriction: Nickel-iron alloys containing approximately 80 atom percent nickel (e.g. "80 Nickel Permalloys"); cobalt-iron alloys containing approximately 90 atom percent cobalt; and iron-silicon alloys containing approximately 6.5 wt. percent silicon. Of these alloys, permalloys have been used more widely than the others because they can be tailored to achieve both zero magnetostriction and low magnetic anisotropy. However, these alloys are prone to be sensitive to mechanical shock, which limits their applications. Cobalt-iron alloys do not provide excellent soft magnetic properties due to their strong negative magnetocrystalline anisotropy. Although some improvements have been made recently in producing iron-based crystalline alloys containing 6.5% silicon [J. Appl. Phys. Vol. 64, p.5367 (1988)], wide acceptance of them as a technologically competitive material is yet to be seen.

As mentioned above, magnetocrystalline anisotropy is effectively absent in metallic glass alloys due to the absence of crystal structures. It is, therefore, desirable to seek glassy metals with zero magnetostriction. The above mentioned chemical compositions which led to zero or near-magnetostriction in crystalline alloys were thought to give some clues to this effort. The results, however, were disappointing. To this date, only Co-rich and Co—Ni-based alloys with small amount of iron have shown zero or near-zero magnetostriction in glassy states. Examples for these alloys have been reported for $Co_{72}Fe_3P_{16}B_6Al_3$ (AIP Conference Proceedings, No. 24, pp.745–746 (1975)) and $Co_{31.2}Fe_{7.8}Ni_{39.0}B_{14}Si_8$ (Proceedings of 3$^{rd}$ International Conference on Rapidly Quenched Metals, p.183 (1979)). Co-rich metallic glass alloys with near-zero magnetostriction are commercially available under the trade names of METGLAS® alloys 2705M and 2714A (Honeywell International Inc) and VITROVAC®6025 and 6030 (Vacuumschmelze GmbH). These alloys have been used in various magnetic components operated at high frequencies. Although the above-mentioned Co—Ni based alloy show near-zero magnetostriction, this and similar alloys have never been widely commercialized. Only one alloy (VITROVAC 6006) based on Co—Ni-based metallic glass alloys has been commercially available for anti-theft marker application (U.S. Pat. No. 5,037,494). These alloys have saturation magnetic induction below 0.5 T and have limited applications. For example, to compensate the low level of saturation magnetic induction of these alloys, a thin and narrow ribbon is required to achieve a workable anti-theft or electronic article surveillance marker. In addition, this ribbon has to be heat-treated in a magnetic field to realize the desired property as a magnetic marker in electronic article surveillance systems. Such heat-treatment sometimes results in a brittle ribbon, which makes it difficult to cut the ribbon to a desired length for an electronic article surveillance marker and, in turn, leads to a fragile marker in actual operation. Clearly desirable are new magnetic metallic glass alloys based on Co and Ni that are magnetically more versatile and mechanically more ductile than the existing alloy for applications in electronic article surveillance systems.

SUMMARY OF INVENTION

In accordance with the invention, there is provided a magnetic alloy that is at least 70% glassy and which has a low magnetostriction. The metallic glass alloy has the composition $Co_aNi_bFe_cM_dB_eSi_fC_g$ where M is at least one element selected from the group consisting of Cr, Mo, Mn and Nb; "a–g" are in atom percent and the sum of "a–g" equals 100; "a" ranges from about 25 to about 60; "b" ranges from about 5 to about 45; "c" ranges from about 6 to about 12; "d" ranges from 0 to about 3; "e" ranges from about 5 to about 25; "f" ranges from 0 to about 15; and "g" ranges from 0 to about 6. The metallic glass alloy has a value of the saturation magnetostriction ranging from about −3 to +3 ppm. The metallic glass alloy is cast by rapid solidification from the melt into ribbon or sheet or wire form. Depending on the need, the metallic glass alloy is heat-treated (annealed) with or without a magnetic field below its crystallization temperature. The metallic glass alloy thus prepared is cut into a desired strip which preferably has a non-linear B—H behavior when measured along the strip's length direction. The strip, whether it is heat-treated or not, is ductile in order to realize a workable magnetic marker for electronic article surveillance applications.

BRIEF DESCRIPTION OF THE DRAWINGS

The invention will be more fully understood and further advantages will become apparent when reference is made to the following detailed description of the invention and the accompanying drawings.

DETAILED DESCRIPTION OF THE INVENTION

Figure 1:
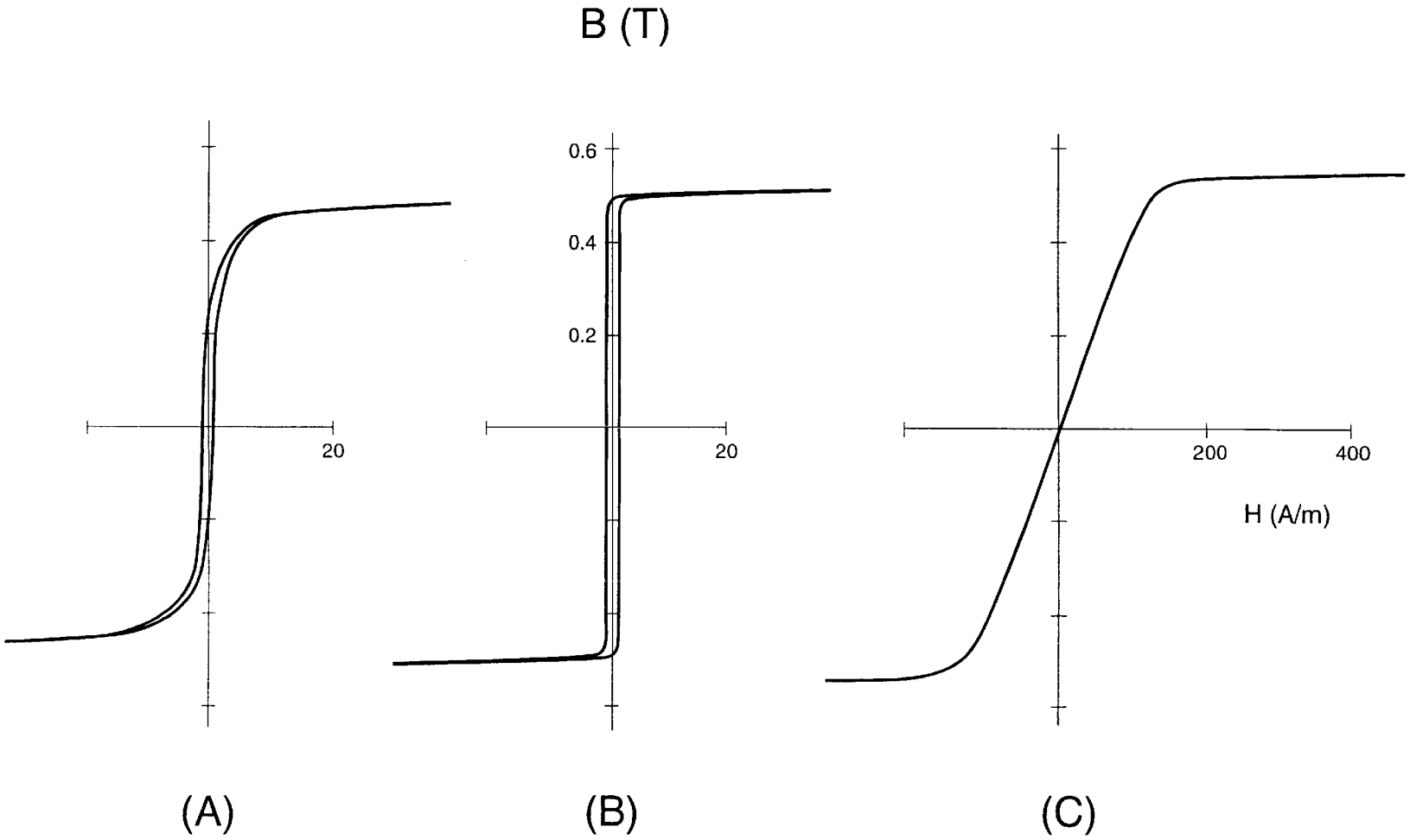
FIGS. 1(A), 1(B) and 1(C) are graphs depicting the B—H characteristics of two representative alloys of the present invention

A metallic glass alloy with low saturation magnetostriction provides a number of opportunities for its use in electronic article surveillance applications. In addition, if the alloy is inexpensive, its technological usefulness will be enhanced. The metallic glass alloy of the present invention has the following composition: $Co_aNi_bFe_cM_dB_eSi_fC_g$, where M is at least one element selected from the group consisting of Cr, Mo, Mn and Nb; "a–g" are in atom percent and the sum of "a–g" equals 100; "a" ranges from about 25 to about 60; "b" ranges from about 5 to about 45; "c" ranges from about 6 to about 12; "d" ranges from 0 to about 3; "e" ranges from about 5 to about 25; "f" ranges from 0 to about 15; and "g" ranges from 0 to about 6. The metallic glass alloy has a value of the saturation magnetostriction ranging from about −3 to +3 ppm. The purity of the above composition is that found in normal commercial practice. The metallic glass alloy is conveniently prepared by techniques readily available elsewhere (see, for example, U.S. Pat. No. 3,845,805 issued Nov. 5, 1974, and U.S. Pat. No. 3,856,513 issued Dec. 24, 1974). In general, the metallic glass alloy, in the form of continuous ribbon, wire, etc., is quenched from the melt of a desired composition at a rate of at least about $10^5$ K/s. The sum of boron, silicon and carbon of about 20 atom percent of the total alloy composition is compatible with the alloy's glass forming ability. However, it is preferred that the content of M, i.e. the quantity "d" does not exceed about 2 atom percent by very much when the sum "e+f+g" exceeds 20 atom percent. The metallic glass alloy of the present invention is substantially glassy. That is to say, it is at least 70% glassy, preferably at least about 95% glassy, and, most preferably, 100% glassy as determined by x-ray diffractometry, transmission electron microscopy and/or differential scanning calorimetry.

Representative metallic glass alloys prepared in accordance with the present invention are listed in Table I, in which the alloys' as-cast properties such as saturation induction ($B_s$), saturation magnetostriction ($\lambda_s$), and the first crystallization temperature ($T_{xl}$) are shown.

TABLE I

| | Alloy Composition (atom %) | $B_s$ (T) | $\lambda_s$ (ppm) | $T_{x1}$ (° C.) |
|---|---|---|---|---|
| 1 | $Co_{55}Ni_{10}Fe_{10}Mo_2B_{20}Si_3$ | 0.79 | 2.1 | 430 |
| 2 | $Co_{45}Ni_{25}Fe_{10}B_{18}Si_2$ | 0.87 | 0.3 | 431 |
| 3 | $Co_{43}Ni_{27}Fe_{10}B_{18}Si_2$ | 0.80 | 0.4 | 428 |
| 4 | $Co_{43}Ni_{25}Fe_{10}Mo_2B_{16}Si_2C_2$ | 0.75 | 0.9 | 436 |
| 5 | $Co_{43}Ni_{25}Fe_{10}Mo_2B_{15}Si_2C_3$ | 0.73 | 1.4 | 429 |
| 6 | $Co_{41}Ni_{29}Fe_{10}B_{18}Si_2$ | 0.82 | 0.3 | 425 |
| 7 | $Co_{37.5}Ni_{32.5}Fe_9Mo_1B_{18}Si_2$ | 0.62 | 0.6 | 427 |
| 8 | $Co_{37.5}Ni_{32.5}Fe_9Mo_1B_{14}Si_6$ | 0.64 | −1.4 | 414 |
| 9 | $Co_{37.5}Ni_{32.5}Fe_9Mo_1B_{10}Si_{10}$ | 0.59 | −0.7 | 416 |
| 10 | $Co_{37.5}Ni_{32.5}Fe_9Mo_1B_6Si_{14}$ | 0.64 | −1.2 | 407 |
| 11 | $Co_{37}Ni_{31}Fe_{12}B_{18}Si_2$ | 0.85 | 2.1 | 430 |
| 12 | $Co_{37}Ni_{33}Fe_{10}B_{18}Si_2$ | 0.78 | 0.4 | 421 |
| 13 | $Co_{36}Ni_{32}Fe_{12}B_{18}Si_2$ | 0.81 | 2.3 | 430 |
| 14 | $Co_{36}Ni_{35}Fe_8Mo_1B_{18}Si_2$ | 0.65 | −1.4 | 402 |
| 15 | $Co_{36}Ni_{35}Fe_8Mo_1B_{10}Si_{10}$ | 0.62 | −0.2 | 399 |
| 16 | $Co_{36}Ni_{35}Fe_8Mo_1B_6Si_{14}$ | 0.56 | 2.3 | 388 |
| 17 | $Co_{35.4}Ni_{33.9}Fe_{7.7}Mo_1B_{15}Si_7$ | 0.57 | −0.3 | 460 |
| 18 | $Co_{35.2}Ni_{33}Fe_{7.8}B_{16}Si_8$ | 0.51 | −0.3 | 481 |

TABLE I-continued

| Alloy | Composition (atom %) | $B_s$ (T) | $\lambda_s$ (ppm) | $T_{x1}$ (° C.) |
|---|---|---|---|---|
| 19 | $Co_{35}Ni_{33}Fe_{12}B_{18}Si_2$ | 0.81 | 1.9 | 429 |
| 20 | $Co_{35}Ni_{34}Fe_{11}B_{18}Si_2$ | 0.75 | 1.2 | 423 |
| 21 | $Co_{35}Ni_{35}Fe_{10}B_{18}Si_2$ | 0.71 | 0.6 | 415 |
| 22 | $Co_{35}Ni_{34}Fe_{11}B_{16}Si_4$ | 0.73 | 1.8 | 424 |
| 23 | $Co_{34.5}Ni_{33}Fe_{7.5}Mo_1B_{16}Si_8$ | 0.51 | −1.0 | 484 |
| 24 | $Co_{32.5}Ni_{37.5}Fe_9Mo_1B_{18}Si_2$ | 0.62 | 0.6 | 405 |
| 25 | $Co_{32.5}Ni_{37.5}Fe_8Mo_1B_{14}Si_6$ | 0.62 | 1.4 | 407 |
| 26 | $Co_{32.5}Ni_{37.5}Fe_9Mo_1B_{16}Si_4$ | 0.52 | 1.4 | 391 |
| 27 | $Co_{31}Ni_{43}Fe_7B_{17}Si_2$ | 0.63 | −0.9 | 367 |
| 28 | $Co_{31}Ni_{41}Fe_9B_{17}Si_2$ | 0.70 | −1.5 | 363 |
| 29 | $Co_{31}Ni_{41}Fe_7B_{19}Si_2$ | 0.56 | −0.5 | 412 |
| 30 | $Co_{31}Ni_{41}Fe_7B_{17}Si_4$ | 0.50 | −0.3 | 434 |
| 31 | $Co_{31}Ni_{39}Fe_7B_{19}Si_4$ | 0.50 | 0.1 | 477 |
| 32 | $Co_{31}Ni_{39}Fe_9B_{19}Si_2$ | 0.65 | 0.1 | 412 |
| 33 | $Co_{31}Ni_{39}Fe_9B_{17}Si_4$ | 0.60 | −0.8 | 433 |
| 34 | $Co_{31}Ni_{37}Fe_9B_{19}Si_4$ | 0.57 | 0.6 | 478 |
| 35 | $Co_{31}Ni_{38}Fe_{10}Mo_2B_{17}Si_2$ | 0.60 | 0.6 | 427 |
| 36 | $Co_{30}Ni_{38}Fe_{10}Mo_2B_{18}Si_2$ | 0.54 | 0.8 | 446 |
| 37 | $Co_{30}Ni_{38}Fe_{10}Mo_2B_{14}Si_6$ | 0.57 | 1.5 | 433 |
| 38 | $Co_{30}Ni_{38}Fe_{10}Mo_2B_{17}Si_2C_1$ | 0.53 | 0.6 | 440 |
| 39 | $Co_{30}Ni_{38}Fe_{10}Mo_2B_{16}Si_2C_2$ | 0.57 | 0.6 | 433 |
| 40 | $Co_{30}Ni_{38}Fe_{10}Mo_2B_{15}Si_2C_3$ | 0.54 | 0.4 | 427 |
| 41 | $Co_{30}Ni_{41}Fe_{10}Mo_2B_{15}Si_2$ | 0.65 | 0.7 | 398 |
| 42 | $Co_{30}Ni_{38}Fe_{10}Mo_2B_{13}Si_2C_5$ | 0.56 | 0.8 | 409 |
| 43 | $Co_{30}Ni_{37.5}Fe_{10}Mo_{2.5}B_{18}Si_2$ | 0.56 | −1.0 | 433 |
| 44 | $Co_{30}Ni_{40}Fe_9Mo_1B_{18}Si_2$ | 0.65 | −1.2 | 405 |
| 45 | $Co_{30}Ni_{40}Fe_9Mo_1B_{14}Si_6$ | 0.58 | 0.5 | 411 |
| 46 | $Co_{30}Ni_{40}Fe_9Mo_1B_{16}Si_4$ | 0.60 | −0.3 | 411 |
| 47 | $Co_{30}Ni_{40}Fe_8Mo_1B_{18}Si_3$ | 0.55 | 0.7 | 416 |
| 48 | $Co_{30}Ni_{40}Fe_8Mo_1B_{17}Si_{2.3}C_{1.7}$ | 0.58 | −0.3 | 394 |
| 49 | $Co_{30}Ni_{40}Fe_8Mo_2B_{18}Si_2$ | 0.52 | 0.5 | 504 |
| 50 | $Co_{30}Ni_{40}Fe_8Mo_2B_{13}Si_2C_5$ | 0.51 | 0.3 | 409 |
| 51 | $Co_{30}Ni_{40}Fe_{10}B_{18}Si_2$ | 0.69 | 0.2 | 416 |
| 52 | $Co_{30}Ni_{40}Fe_{10}B_{16}Si_2C_2$ | 0.66 | 0.5 | 406 |
| 53 | $Co_{30}Ni_{40}Fe_{10}B_{15}Si_2C_3$ | 0.68 | 0.3 | 401 |
| 54 | $Co_{30}Ni_{40}Fe_{10}B_{14}Si_2C_4$ | 0.69 | −0.6 | 393 |
| 55 | $Co_{30}Ni_{40}Fe_{10}B_{13}Si_2C_5$ | 0.68 | −1.1 | 389 |
| 56 | $Co_{30}Ni_{40}Fe_{10}B_{16}Si_4$ | 0.66 | 0.8 | 417 |
| 57 | $Co_{30}Ni_{40}Fe_{10}B_{14}Si_4C_2$ | 0.66 | 0.8 | 407 |
| 58 | $Co_{30}Ni_{40}Fe_{10}B_{12}Si_4C_4$ | 0.64 | 0.7 | 394 |
| 59 | $Co_{30}Ni_{38}Fe_{10}B_{20}Si_2$ | 0.66 | 1.0 | 466 |
| 60 | $Co_{30}Ni_{38}Fe_{10}B_{18}Si_2C_2$ | 0.62 | 1.1 | 481 |
| 61 | $Co_{30}Ni_{38}Fe_{10}B_{16}Si_2C_4$ | 0.61 | 0.6 | 439 |
| 62 | $Co_{30}Ni_{36}Fe_{10}B_{22}Si_2$ | 0.58 | 1.0 | 490 |
| 63 | $Co_{30}Ni_{36}Fe_{10}B_{18}Si_2C_4$ | 0.58 | 1.0 | 479 |
| 64 | $Co_{29}Ni_{45}Fe_7B_{17}Si_2$ | 0.63 | 1.4 | 342 |
| 65 | $Co_{29}Ni_{43}Fe_7B_{19}Si_2$ | 0.55 | 0.5 | 396 |
| 66 | $Co_{29}Ni_{43}Fe_7B_{17}Si_4$ | 0.53 | 0.2 | 403 |
| 67 | $Co_{29}Ni_{41}Fe_9B_{19}Si_2$ | 0.58 | −0.4 | 434 |
| 68 | $Co_{29}Ni_{39}Fe_9B_{19}Si_4$ | 0.51 | −0.4 | 482 |
| 69 | $Co_{29}Ni_{40}Fe_9B_{20}Si_2$ | 0.58 | 0.1 | 454 |

All the alloys listed in Table I show a saturation induction, $B_s$, exceeding 0.5 tesla and the saturation magnetostriction within the range between −3 ppm and +3 ppm. It is desirable to have a high saturation induction from the standpoint of the magnetic component's size. A magnetic material with a higher saturation induction results in a smaller component size. In many electronic devices including electronic article surveillance systems currently used, a saturation induction exceeding 0.5 tesla (T) is considered sufficiently high. Although the alloys of the present invention have the saturation magnetostriction range between −3 ppm and +3 ppm, a more preferred range is between −2 ppm and +2 ppm, and the most preferred is a near-zero value. Examples of the more preferred alloys of the present invention thus include:

$Co_{45}Ni_{25}Fe_{10}B_{18}Si_2$, $Co_{43}Ni_{27}Fe_{10}B_{18}Si_2$, $Co_{43}Ni_{25}Fe_{10}Mo_2B_{16}Si_2C_2$, $Co_{43}Ni_{25}Fe_{10}Mo_2B_{15}Si_2C_3$, $Co_{41}Ni_{29}Fe_{10}B_{18}Si_2$, $Co_{37.5}Ni_{32.5}Fe_9Mo_1B_{18}Si_2$, $Co_{37.5}Ni_{32.5}Fe_9Mo_1B_{14}Si_6$, $Co_{37.5}Ni_{32.5}Fe_9Mo_1B_{10}Si_{10}$, $Co_{37.5}Ni_{32.5}Fe_9Mo_1B_6Si_{14}$, $Co_{37}Ni_{33}Fe_{10}B_{18}Si_2$, $Co_{36}Ni_{35}Fe_8Mo_1B_{18}Si_2$, $Co_{36}Ni_{35}Fe_8Mo_1B_{10}Si_{10}$, $Co_{35.4}Ni_{33.9}Fe_{7.7}Mo_1B_{15}Si_7$, $Co_{35.2}Ni_{33}Fe_{7.8}B_{16}Si_8$, $Co_{35}Ni_{33}Fe_{12}B_{18}Si_2$, $Co_{35}Ni_{34}Fe_{11}B_{18}Si_2$, $Co_{35}Ni_{35}Fe_{10}B_{18}Si_2$, $Co_{35}Ni_{34}Fe_{11}B_{16}Si_4$, $Co_{34.5}Ni_{33}Fe_{7.5}Mo_1B_{16}Si_8$, $Co_{32.5}Ni_{37.5}Fe_9Mo_1B_{18}Si_2$, $Co_{32.5}Ni_{37.5}Fe_9Mo_1B_{14}Si_6$, $Co_{32.5}Ni_{37.5}Fe_9Mo_1B_6Si_{14}$, $Co_{31}Ni_{43}Fe_7B_{17}Si_2$, $Co_{31}Ni_{41}Fe_9B_{17}Si_2$, $Co_{31}Ni_{41}Fe_7B_{19}Si_2$, $Co_{31}Ni_{41}Fe_7B_{17}Si_4$, $Co_{31}Ni_{39}Fe_7B_{19}Si_4$, $Co_{31}Ni_{39}Fe_9B_{19}Si_2$, $Co_{31}Ni_{39}Fe_9B_{17}Si_4$, $Co_{31}Ni_{39}Fe_9B_{19}Si_2$, $Co_{31}Ni_{38}Fe_{10}Mo_2B_{17}Si_2$, $Co_{30}Ni_{38}Fe_{10}Mo_2B_{18}Si_2$, $Co_{30}Ni_{38}Fe_{10}Mo_2B_{17}Si_2C_1$, $Co_{30}Ni_{38}Fe_{10}Mo_2B_{16}Si_2C_2$, $Co_{30}Ni_{38}Fe_{10}Mo_2B_{15}Si_2C_3$, $Co_{30}Ni_{41}Fe_{10}Mo_2B_{15}Si_2$, $Co_{30}Ni_{38}Fe_{10}Mo_2B_{14}Si_6$, $Co_{30}Ni_{38}Fe_{10}Mo_2B_{13}Si_2C_5$, $Co_{30}Ni_{40}Fe_8Mo_2B_{18}Si_2$, $Co_{30}Ni_{40}Fe_8Mo_2B_{13}Si_2C_5$, $Co_{30}Ni_{40}Fe_{10}B_{18}Si_2$, $Co_{30}Ni_{40}Fe_9Mo_1B_{18}Si_2$, $Co_{30}Ni_{40}Fe_{10}B_{15}Si_2C_3$, $Co_{30}Ni_{40}Fe_{10}B_{14}Si_2C_4$, $Co_{30}Ni_{40}Fe_{10}B_{13}Si_2C_5$, $Co_{30}Ni_{40}Fe_{10}B_{16}Si_4$, $Co_{30}Ni_{40}Fe_{10}B_{14}Si_4C_2$, $Co_{30}Ni_{40}Fe_{10}B_{12}Si_4C_4$, $Co_{30}Ni_{40}Fe_{10}B_{20}Si_2$, $Co_{30}Ni_{38}Fe_{10}B_{18}Si_2C_2$, $Co_{30}Ni_{36}Fe_{10}B_{16}Si_2C_4$, $Co_{30}Ni_{36}Fe_{10}B_{22}Si_2$, $Co_{30}Ni_{34}Fe_{10}B_{18}Si_2C_4$, $Co_{30}Ni_{40}Fe_9Mo_0B_{18}Si_2$, $Co_{30}Ni_{40}Fe_9Mo_1B_{14}Si_6$, $Co_{30}Ni_{40}Fe_9Mo_1B_{16}Si_4$, $Co_{30}Ni_{37.5}Fe_{10}Mo_{2.5}B_{18}Si_2$, $Co_{30}Ni_{40}Fe_8Mo_1B_{18}Si_3$, $Co_{30}Ni_{40}Fe_8Mo_1B_{17}Si_{2.3}C_{1.7}$, $Co_{29}Ni_{43}Fe_7B_{19}Si_2$, $Co_{29}Ni_{41}Fe_9B_{19}Si_2$, $Co_{29}Ni_{43}Fe_7B_{17}Si_4$, $Co_{29}Ni_{45}Fe_7B_{17}Si_2$, $Co_{29}Ni_{39}Fe_9B_{19}Si_4$ and $Co_{29}Ni_{40}Fe_9B_{20}Si_2$.

In electronic article surveillance systems utilizing higher harmonics, the magnetic marker must possess a non-linear B—H behavior with B—H squareness ratios exceeding about 0.5 and preferrably exceeding about 0.75. FIG. 1 represents typical B—H loops well-known to those skilled in the art. The vertical axis is scaled to the magnetic induction B in tesla (T) and the horizontal axis is scaled to the applied magnetic field H in amperes/meter (Aim). FIG. 1A corresponds to the case where a marker strip is in the as-cast condition. Some of the metallic glass alloys in Table 1 exhibit rectangular B—H behaviors similar to FIG. 1 in the as-cast condition and are most suited for use as a magnetic marker since they are ductile and therefore easily cut and fabricated.

Heat treatment or annealing of the metallic glass alloy of the present invention favorably modifies the magnetic properties of the alloy. The choice of the annealing conditions differs depending on the required performance of the envisioned component. Since a non-linear B—H behavior is required of a magnetic marker in electronic article surveillance systems, the annealing condition then may require a magnetic field applied along the direction of the marker strip's length direction. FIG. 1B corresponds to the case where the marker strip is heat-treated with a magnetic field applied along the strip's length direction. It has been noted that the B—H loop is highly non-linear and square. This kind of behavior is very well suited for the alloy to be used as a magnetic marker in electronic article surveillance systems. Specific annealing conditions must be found for different types of applications using the metallic glass alloys of the present invention. Such examples are given below:

EXAMPLES

1. Sample Preparation

The metallic glass alloys listed in Table I were rapidly quenched with a cooling rate of approximately $10^6$ K/s from the melt following the techniques taught by Chen et al in U.S. Pat. No. 3,856,513. The resulting ribbons, typically 10 to 30 $\mu$m thick and 0.5 to 2.5 cm wide, were determined to be free of significant crystallinity by x-ray diffractometry (using Cu—K$\alpha$ radiation) and differential scanning calorimetry. The metallic glass alloys in the ribbon form were strong, shiny, hard and ductile.

2. Magnetic Measurements

The saturation magneization, $M_s$, of each sample, was measured with a commercial vibrating sample magnetometer (Princeton Applied Research). In this case, the ribbon was cut into several small squares (approximately 2 mm×2 mm) which were placed in a sample holder with their plane parallel to the applied field reaching a maximum of about 800 kA/m (or 10 kOe). The saturation induction $B_s$ ($=4\pi M_s D$) was then calculated using the measured mass density D.

The saturation magnetostriction was measured on a piece of ribbon sample (approximately 3 mm×10 mm in size) which was attached to a metallic strain gauge. The sample with the strain gauge was placed in a magnetic field of about 40 kA/m (500 Oe) The strain change in the strain gauge was measured by a resistance bridge circuit described elsewhere [Rev. Scientific Instrument, Vol.51, p.382 (1980)] when the field direction was changed from the sample length direction to the width direction. The saturation magnetostriction was then determined from the formula $\lambda_s=\frac{2}{3}$ (difference in the strain between the two directions).

The ferromagnetic Curie temperatue, $\theta_f$, was measured by an inductance method and also monitored by differential scanning calorimetry, which was used primarily to determine the crystallization temperatures. Depending on the chemistry, crystallization sometimes takes place in more than one step. Since the first crystallization temperature is more relevant to the present application, the first crystallization temperatures of the metallic glass alloys of the present invention are listed in Table I.

Continuous ribbons of the metallic glass alloys prepared in accordance with the procedure described in Example 1 were wound onto bobbins (3.8 cm O.D.) to form magnetically closed toroidal sample. Each sample toroidal core contained from about 1 to about 30 g of ribbon and had primary and secondary copper windings which were wired to a commercially available B—H loop tracer to obtain B—H hysteresis loops of the kind shown in FIG. 1.

Continuous ribbons of the metallic glass alloys prepared in accordance with the procedure described in Example 1 were slit to widths ranging from about 1 mm to about 3 mm and cut into strips of lengths of about 76 mm. Each strip was placed in an exciting ac field at a fundamental frequency and its higher harmonics response was detected by a coil containing the strip. The harmonics response signal detected in the coil was monitored by a digital voltmeter and by a conventional oscilloscope.

3. Magnetic Harmonic Markers using As-cast Alloys

Toroidal cores prepared in accordance with Example 2 using as-cast alloys of the present invention were tested. The results of dc coercivity and dc B—H squareness ratio of Alloys 2, 3, 6, 20, 21, 39, 41, 49, 56, 57, and 61 of Table I are given in Table II.

TABLE II

| Alloy No. | dc Coercivity (A/m) | dc Squareness Ratio |
|---|---|---|
| 2 | 1.8 | 0.93 |
| 3 | 3.1 | 0.88 |
| 6 | 2.4 | 0.90 |

TABLE II-continued

| Alloy No. | dc Coercivity (A/m) | dc Squareness Ratio |
|---|---|---|
| 20 | 2.6 | 0.66 |
| 21 | 2.6 | 0.86 |
| 39 | 2.2 | 0.72 |
| 41 | 2.3 | 0.94 |
| 49 | 0.6 | 0.88 |
| 56 | 1.5 | 0.50 |
| 57 | 1.8 | 0.92 |
| 61 | 3.2 | 0.51 |

Low coercivities and B—H squareness ratios exceeding about 0.5 indicate that the alloys of the present invention in their as-cast conditions are suited for variety of magnetic applications including electronic article surveillance, magnetic sensors, power electronics and the like. Those alloys with higher squareness ratios are especially suited for use in electronic article surveillance systems based on magnetic harmonics. Some of these as-cast strips were evaluated according to the measurement technique described in Example 2 and the results are summarized in Table III below.

TABLE III

The as-cast strips made from Alloy 20, 21, 67, and 69 of Table I and control strips were excited at a fundamental frequency of 2.4 kHz and their 25$^{th}$ harmonic signal responses were detected. The excitation level was kept constant and the signal detected in a 524-turn coil was compared. The control strip was a 2 mm wide, 76-mm long strip made of METGLAS ® 2705M alloy and taken out of a commercially available marker widely used in video rental stores. For comparison purpose, 1 mm and 3 mm wide strips of METGLAS ® 2705M alloy were prepared and tested.

| Alloy | Width (mm) | 25$^{th}$ Harmonic Voltage (mV) |
|---|---|---|
| Control | 3 | 150 ± 10 |
| Control | 2 | 160 ± 10 |
| Control | 1 | 190 ± 10 |
| No. 20 | 3 | 230 ± 10 |
| No. 21 | 3 | 220 ± 10 |
| No. 67 | 3 | 240 ± 10 |
| No. 69 | 3 | 240 ± 10 |
| No. 67 | 1 | 290 ± 10 |
| No. 69 | 1 | 290 ± 10 |

The data shown above indicate that the harmonic markers made from the strips of the as-cast alloys of the present invention perform equally or better than those commercially available.

4. Magnetic Harmonic Markers using Annealed Alloys

Toroidal cores prepared in accordance with the procedure of Example 2 were annealed with a magnetic field of 800 A/m applied along the circumference direction of the toroids. The results of dc B—H hysteresis loops taken on some of the alloys from Table 1 are listed in Table IV.

TABLE IV

Coercivity $H_c$ and B–H squareness ratio ($B_r/B_s$ where $B_r$ is the remanent induction) for some of the metallic glass alloys of Table I. The alloys were annealed at 320° C. for 2 hours with a dc magnetic field of 800 A/m applied along the core circumference direction.

| Alloy No | $H_c$ (A/m) | B–H Squareness Ratio |
|---|---|---|
| 1 | 1.3 | 0.93 |
| 2 | 2.3 | 0.96 |
| 5 | 1.1 | 0.93 |
| 6 | 3.6 | 0.93 |

TABLE IV-continued

Coercivity $H_c$ and B–H squareness ratio ($B_r/B_s$ where $B_r$ is the remanent induction) for some of the metallic glass alloys of Table I. The alloys were annealed at 320° C. for 2 hours with a dc magnetic field of 800 A/m applied along the core circumference direction.

| Alloy No | $H_c$ (A/m) | B–H Squareness Ratio |
|---|---|---|
| 11 | 2.0 | 0.98 |
| 19 | 1.2 | 0.95 |
| 35 | 1.2 | 0.93 |
| 40 | 0.6 | 0.87 |
| 41 | 2.4 | 0.95 |
| 49 | 0.4 | 0.88 |
| 51 | 1.0 | 0.93 |
| 54 | 1.6 | 0.89 |
| 57 | 1.0 | 0.93 |

These results show that the metallic glass alloys of the present invention achieve a high dc B—H squareness ratio exceeding 0.85 with low coercivities of less than 4 A/m when annealed with a dc magnetic field applied along the direction of the magnetic excitation, indicating further that these alloys are suited for use as markers in electronic article surveillance systems utilizing magnetic harmonics. Table V summarizes the results of the harmonic response of the strips from Table I which were heat-treated at 370° C. for 1.5 hours with a magnetic field of 10 Oe applied along the strip's length direction in accordance with Example 2.

TABLE V

Heat-treated strips of Alloy No. 21, 67 and 69 from Table I were excited at 2.4 kHz and its 25th harmonic response signal. The measurement conditions are the same as those given in the caption of Table III.

| Alloy | Width (mm) | 25th Harmonic Response (mV) |
|---|---|---|
| No. 21 | 3 | 130 ± 10 |
| No. 67 | 3 | 180 ± 10 |
| No. 69 | 3 | 170 ± 10 |
| No. 67 | 1 | 200 ± 10 |
| No. 69 | 1 | 195 ± 10 |

The data given in Table V indicate that heat-treated alloys of the present invention perform equally or better than the commercially available alloy (control alloy in Table III) when used as markers of electronic article surveillance systems utilizing magnetic harmonics.

Having thus described the invention rather full detail, it will be understood that this detail need not be strictly adhered to but that further changes and modifications may suggest themselves to one skilled in the art all falling within the scope of the invention as defined by the subjoined claims.

What is claimed is:

1. A magnetic maker for an electronic article surveillance system utilizing magnetic harmonics, said maker comprising a strip, in ribbon or wire form, made of an as-cast magnetic alloy that is at least 70% glassy;

said as-cast magnetic alloy having formula $Co_aNi_bFe_cM_dB_eSi_fC_g$ wherein M is at least one element selected from the group consisting of Cr, Mo, Mn and Nb, "a–g" are in atom percent and the sum of "a–g" equals 100, "a" ranges froth about 25 to about 60, "b" ranges from about 5 to about 45, "c" ranges from about 6 to about 12, "d" ranges from about 0 to about 3, "e" ranges from about 5 to 25, "f" ranges from about 0 to about 15 and "g" ranges from about 0 to 6; and said alloy having a value of the saturation magnetostriction between $-3\times10^{-6}$ and $+3\times10^{-6}$, a value of saturation induction exceeding 0.5 T, and a non-linear B—H hysteresis loop having a B—H squareness ratio exceeding about 0.66 under dc excitation.

2. The magnetic maker of claim 1 wherein said as-cast magnetic alloy has a composition selected from the group consisting of:

$Co_{45}Ni_{25}Fe_{10}B_{18}Si_2$, $Co_{43}Ni_{27}Fe_{10}B_{18}Si_2$, $Co_{43}Ni_{25}Fe_{10}Mo_2B_{16}Si_2C_2$, $Co_{43}Ni_{25}Fe_{10}Mo_2B_{15}Si_2C_3$, $Co_{41}Ni_{29}Fe_{10}B_{18}Si_2$, $Co_{37.5}Ni_{32.5}Fe_9Mo_1B_{18}Si_2$, $Co_{37.5}Ni_{32.5}Fe_9Mo_1B_{14}Si_6$, $Co_{37.5}Ni_{32.5}Fe_9Mo_1B_{10}Si_{10}$, $Co_{37.5}Ni_{32.5}Fe_9Mo_1B_6Si_{14}$, $Co_{37}Ni_{33}Fe_{10}B_{18}Si_2$, $Co_{36}Ni_{35}Fe_8Mo_1B_{18}Si_2$, $Co_{36}Ni_{35}Fe_8Mo_1B_{10}Si_{10}$, $Co_{35.4}Ni_{33.9}Fe_{7.7}Mo_1B_{15}Si_7$, $Co_{35.2}Ni_{33}Fe_{7.8}B_{16}Si_8$, $Co_{35}Ni_{33}Fe_{12}B_{18}Si_2$, $Co_{35}Ni_{34}Fe_{11}B_{18}Si_2$, $Co_{35}Ni_{35}Fe_{10}B_{18}Si_2$, $Co_{35}Ni_{34}Fe_{11}B_{16}Si_4$, $Co_{34.5}Ni_{33}Fe_{7.5}Mo_1B_{16}Si_8$, $Co_{32.5}Ni_{37.5}Fe_9Mo_1B_{18}Si_2$, $Co_{32.5}Ni_{37.5}Fe_9Mo_1B_{14}Si_6$, $Co_{32.5}Ni_{37.5}Fe_9Mo_1B_6Si_{14}$, $Co_{31}Ni_{43}Fe_7B_{17}Si_2$, $Co_{31}Ni_{41}Fe_9B_{17}Si_2$, $Co_{31}Ni_{41}Fe_7B_{19}Si_2$, $Co_{31}Ni_{41}Fe_7B_{17}Si_4$, $Co_{31}Ni_{39}Fe_7B_{19}Si_4$, $Co_{31}Ni_{39}Fe_9B_{19}Si_2$, $Co_{31}Ni_{39}Fe_9B_{19}Si_2$, $Co_{31}Ni_{39}Fe_9B_{19}Si_2$, $Co_{31}Ni_{38}Fe_{10}Mo_2B_{17}Si_2$, $Co_{30}Ni_{38}Fe_{10}Mo_2B_{18}Si_2$, $Co_{30}Ni_{38}Fe_{10}Mo_2B_{17}Si_2C_1$, $Co_{30}Ni_{38}Fe_{10}Mo_2B_{16}Si_2C_2$, $Co_{30}Ni_{38}Fe_{10}Mo_2B_{15}Si_2C_3$, $Co_{30}Ni_{41}Fe_{10}Mo_2B_{15}Si_2$, $Co_{30}Ni_{38}Fe_{10}Mo_2B_{14}Si_6$, $Co_{30}Ni_{38}Fe_{10}Mo_2B_{13}Si_2C_5$, $Co_{30}Ni_{40}Fe_8Mo_2B_{18}Si_2$, $Co_{30}Ni_{40}Fe_8Mo_2B_{13}Si_2C_5$, $Co_{30}Ni_{40}Fe_{10}B_{18}Si_2$, $Co_{30}Ni_{40}Fe_9Mo_1B_{18}Si_2$, $Co_{30}Ni_{40}Fe_{10}B_{15}Si_2C_3$, $Co_{30}Ni_{40}Fe_{10}B_{14}Si_2C_4$, $Co_{30}Ni_{40}Fe_{10}B_{13}Si_2C_5$, $Co_{30}Ni_{40}Fe_{10}B_{16}Si_4$, $Co_{30}Ni_{40}Fe_{10}B_{14}Si_4C_2$, $Co_{30}Ni_{40}Fe_{10}B_{12}Si_4C_4$, $Co_{30}Ni_{40}Fe_{10}B_{20}Si_2$, $Co_{30}Ni_{38}Fe_{10}B_{18}Si_2C_2$, $Co_{30}Ni_{38}Fe_{10}B_{16}Si_2C_4$, $Co_{30}Ni_{36}Fe_{10}B_{22}Si_2$, $Co_{30}Ni_{36}Fe_{10}B_{18}Si_2C_4$, $Co_{30}Ni_{40}Fe_9Mo_1B_{18}Si_2$, $Co_{30}Ni_{40}Fe_9Mo_1B_{14}Si_6$, $Co_{30}Ni_{40}Fe_9Mo_1B_{16}Si_4$, $Co_{30}Ni_{37.5}Fe_{10}Mo_{2.5}B_{18}Si_2$, $Co_{30}Ni_{40}Fe_8Mo_1B_{18}Si_3$, $Co_{30}Ni_{40}Fe_8Mo_1B_{17}Si_{2.3}C_{1.7}$, $Co_{29}Ni_{43}Fe_7B_{19}Si_2$, $Co_{29}Ni_{41}Fe_9B_{19}Si_2$, $Co_{29}Ni_{43}Fe_7B_{17}Si_4$, $Co_{29}Ni_{45}Fe_7B_{17}Si_2$, $Co_{29}Ni_{39}Fe_9B_{19}Si_4$, and $Co_{29}Ni_{40}Fe_9B_{20}Si_2$.

3. The magnetic maker of claim 1, wherein said as-cast magnetic alloy has a value has a saturation magnetostriction between $-2\times10^{-6}$ and $+2\times10^{-6}$.

4. The magnetic maker of claim 1, wherein the non-linear B—H hysteresis loop has a B—H squareness ratio exceeding about 0.75 under dc excitation.

* * * * *